US011571601B2

(12) United States Patent
Schrag

(10) Patent No.: US 11,571,601 B2
(45) Date of Patent: Feb. 7, 2023

(54) COMBINATION TRAINING EQUIPMENT

(71) Applicant: BLBW AG, Schwarzsee (CH)

(72) Inventor: Michael Schrag, Schwarzsee (CH)

(73) Assignee: BLBW AG, Schwarzsee (CH)

( * ) Notice: Subject to any disclaimer, the term of this patent is extended or adjusted under 35 U.S.C. 154(b) by 27 days.

(21) Appl. No.: 17/274,198

(22) PCT Filed: Sep. 24, 2019

(86) PCT No.: PCT/EP2019/075671
§ 371 (c)(1),
(2) Date: Mar. 8, 2021

(87) PCT Pub. No.: WO2020/064711
PCT Pub. Date: Apr. 2, 2020

(65) Prior Publication Data

US 2021/0331025 A1 Oct. 28, 2021

(30) Foreign Application Priority Data

Sep. 24, 2018 (CH) ..... 01151/18

(51) Int. Cl.
*A63B 21/00* (2006.01)
*A63B 21/16* (2006.01)
(Continued)

(52) U.S. Cl.
CPC ..... *A63B 21/154* (2013.01); *A63B 21/0087* (2013.01); *A63B 21/026* (2013.01);
(Continued)

(58) Field of Classification Search
CPC ..... A63B 21/0083; A63B 21/0087; A63B 21/154; A63B 21/155; A63B 21/156;
(Continued)

(56) References Cited

U.S. PATENT DOCUMENTS 4,275,882 A 6/1981 Grosser et al.
5,242,344 A * 9/1993 Hundley ..... A63B 21/4047 482/93
(Continued)

FOREIGN PATENT DOCUMENTS

EP 0095226 B1 11/1983
EP 0146274 A * 11/1984 ..... A63B 21/00072
(Continued)

OTHER PUBLICATIONS

International Search Report & Written Opinion in PCT/EP2019/075671 dated Dec. 13, 2019, 13 pages.
(Continued)

*Primary Examiner* — Sundhara M Ganesan
(74) *Attorney, Agent, or Firm* — Pearne & Gordon LLP

(57) ABSTRACT

An apparatus for exercising the muscles. The apparatus includes an exercising device having a power arm or lever, which can be equipped with actuating elements at a first end of the power arm or lever. A second end of the power arm or lever is arranged on a retaining element in a way pivotable about a pivot axis at a first articulated joint. A compression-spring element can be articulated, by way of a first end of the compression-spring element at a first point of articulation on the power arm and articulated, by way of a second end of the compression-spring element at a second point of articulation on the retaining element. A cable-pull arrangement has a cable and is fixed in a releasable manner in a spatial relationship to the exercising device, independently of the exercising device, by means of a first fixing device and is able to be combined with the power arm of the exercising device by means of a second fixing device, so that the cable-pull arrangement is connectible to the exercising device in order for training to take place.

13 Claims, 5 Drawing Sheets

(51) Int. Cl.
*A63B 21/008* (2006.01)
*A63B 21/02* (2006.01)
*A63B 22/00* (2006.01)

(52) U.S. Cl.
CPC ..... *A63B 21/169* (2015.10); *A63B 21/4035* (2015.10); *A63B 21/4047* (2015.10); *A63B 22/0076* (2013.01); *A63B 2022/0079* (2013.01); *A63B 2208/0238* (2013.01); *A63B 2225/093* (2013.01)

(58) Field of Classification Search
CPC ..... A63B 21/1618; A63B 21/1681; A63B 21/159; A63B 21/026; A63B 21/169; A63B 21/4035; A63B 21/4047; A63B 21/4043; A63B 21/4034; A63B 21/16; A63B 21/00072; A63B 22/0076; A63B 22/0087; A63B 23/03508; A63B 23/0355; A63B 2022/0079; A63B 2208/0238; A63B 2208/0204; A63B 2210/50; A63B 2225/098; A63B 2225/093; A63B 23/03525; A63B 21/403
See application file for complete search history.

(56) References Cited

U.S. PATENT DOCUMENTS

| | | | | | |
|---|---|---|---|---|---|
| 5,820,529 | A * | 10/1998 | Weintraub | ..... | A63B 21/0552 482/904 |
| 9,713,738 | B2 * | 7/2017 | Schrag | ..... | A63B 23/0355 |
| 2004/0185988 | A1 | 9/2004 | Hsiung et al. | | |
| 2017/0340914 | A1 * | 11/2017 | Schrag | ..... | A63B 21/023 |

FOREIGN PATENT DOCUMENTS

| | | | | | |
|---|---|---|---|---|---|
| GB | 2173115 | A | 10/1986 | | |
| GB | 2204503 | A * | 11/1988 | ..... | A63B 21/169 |
| WO | 8402659 | A1 | 7/1984 | | |
| WO | 2014146710 | A1 | 9/2014 | | |

OTHER PUBLICATIONS

Translation of International Search Report in PCT/EP2019/075671, 2 pages.

* cited by examiner

COMBINATION TRAINING EQUIPMENT

TECHNICAL FIELD OF THE INVENTION

The present invention relates to an apparatus for exercising, in particular the muscles, comprising an exercising device with a force device and elements combinable therewith, comprising at least one cable-pull arrangement, and a method for retrofitting such an apparatus.

STATE OF THE ART

Devices for exercising the muscles by means of so-called strength machines are generally known. Using corresponding devices, guided two-dimensional training exercises can be carried out in particular, whereby a power arm can be pivoted in one direction against a resistance force, for example against the action of a spring force. The pivoting direction is thereby generally in the vertical direction or also, with another orientation of the power arm, in horizontal direction. With devices of this kind groups of muscles of the human body can be exercised or trained.

Furthermore, exercising devices are known which are flexibly designed, or respectively able to be set and adjusted, in such a way that a comprehensive exercising of the muscles of the human body is possible. Known is a device for exercising the muscles which comprises a power arm or lever, whose one end region can be equipped with actuation elements and which by the other end region is pivotable about a first articulated joint. This first articulated joint is disposed on a retaining element, which is disposed in a rotatable way on a support. On the power arm an end region of a spring element is coupled in an articulated way at a first point of articulation, whose other end region is coupled in an articulated way to the retaining element. The retaining element can be brought into a rotational position with respect to the support and can be locked in this position, so that diverse orientations of the power arm or respectively of the actuation elements are possible and diverse groups of muscles can be exercised. The adjustment and setting options are diverse.

For a comprehensive exercising of the muscles of the human body, but also for therapeutic exercises, besides guided, two-dimensional training programs also free, three-dimensional and in particular long-stroke exercises are of significance. For this purpose, various devices for training are available at fitness or therapy centers, for example, i.e. besides strength machines, so-called pulling devices or cable pulling stations or pulley stations, which use the principle of a cable pull or respectively a pulley. Cable pulling stations are set up such that cable pulls, generally guided via rollers, are operated against a resistance brought about by weights, a cylinder device or an electromotor. To enable holistic training, a multiplicity of exercising devices is necessary which results in high acquisition costs in addition to a high space requirement. These disadvantages become noticeable in particular with respect to training possibilities in the private sphere.

Generally known are universally deployable exercising devices, which unite different exercising possibilities on one apparatus, i.e. which can be changed through more or less complicated equipping and retrofitting. Thus, known from GB 2 173 115 is a multi-purpose physical exercise apparatus, which once set up, is retrofittable or convertible in multiple ways. The exercising device is set up in a room, i.e. is placed on the floor, whereby a power arm is fixable to a vertically extending frame and/or to elements connectible to the frame in different positions to enable different exercising possibilities. The power arm is movable against a resistance element which is connectible, on the one hand, to the frame, and, on the other hand, to the power arm in different positions. Provided on the frame are pulleys, via which one or more cables are led so that a cable can be connected with the power arm when cable pull exercises are carried out. In particular the exercising device standing in the room can be provided with a slidable seat, parallel to the floor, in such a way that in combination with the cable pull devices rowing exercises are able to be carried out. After completion of the training, the apparatus can be folded up and stowed away.

Although the known exercising devices reveal, through the combination of a strength machine with a cable pull station, variable training possibilities, the retrofitting or conversion is complex and the elements necessary therefor take up space.

SUMMARY OF INVENTION

The object of the present invention thus consists in providing an apparatus for exercising the muscles whereby an exercising device is able to be combined with further elements, so that diverse movement sequences are possible for exercising groups of muscles. Furthermore, the apparatus should be able to be set and adjusted in a simple way, whereby its construction is uncomplicated, the space requirements and the empty weight are minimal, and also the costs for such an apparatus can be kept low.

The objects are achieved according to the invention in that the apparatus for exercising the muscles comprises an exercising device with a power arm, which at a first end can be equipped with actuation elements and by a second end is disposed on a retaining element in a way pivotable about a first articulated joint, whereby a spring element, in particular a compression-spring element, is able to be coupled to the power arm in an articulated way by a first end at a first point of articulation and coupled to the retaining element by a second end at a second point of articulation. The apparatus further comprises a cable-pull arrangement with a cable.

The cable-pull arrangement can, by means of a first fixing device independent from the exercising device in a spatial relationship thereto, be detachably fixed to a retaining means. By means of a second fixing device, the cable-pull arrangement is able to be combined with the power arm of the exercising device, so that this cable-pull arrangement is disposed in a spatial and physical relationship to the exercising device.

The cable-pull arrangement is based on the principle of a pulley with a fixed roller arrangement and a loose roller arrangement, each of which can comprise one or more rollers, and via which a cable is led. One end of the cable is detachably received on one of the roller arrangements, or respectively on the loose roller arrangement. For this purpose one cable end can comprise a thickening or an element that is received in a held way in an accommodation on the roller arrangement. The other cable end, also designated as the free end, is designed as end piece or respectively gripping means or gripping element or is able to be equipped with such, for example designed as grips, gripping devices, hand and/or foot straps, wristbands or cuffs or other functional end pieces.

With the first fixing device, disposed on the fixed or loose roller arrangement, the cable-pull arrangement is fixed on a fixing means in a spatial relationship to the exercising device. The first fixing device is thereby designed for universal attachment, for example on a wall or another fixed element, for example on a support dedicated to the training device or an independent support. Thus, the cable-pull arrangement can be fixed at any desired position in spatial relationship to the exercising device that is suitable to provide, with the latter, a universally usable apparatus for exercising the muscles.

The second fixing device is designed on the loose roller arrangement in order to be combined in a way detachable to the power arm or to an actuating element received on the power arm. A hook is preferably disposed on an end region of the second fixing device, which hook can be hooked into an accommodation provided on the power arm in the region of the first end. Alternatively, a loop or strap can be provided on the second fixing device, which loop or strap can be looped around the power arm, or respectively another actuation element disposed thereon.

The cable-pull arrangement designed according to a pulley principle can comprise in the fixed and/or the loose roller arrangement one or more rollers, i.e. deflection rollers about which the cable is led at least partially. Generally in a pulley, depending on the desired translation and extendable cable length, the number of carrier rollers, i.e. fixed rollers, and load rollers, i.e. the loose rollers, can vary. The pulley comprises a fixed roller arrangement, also designated as roller assembly or pulley assembly, with one or more carrier rollers and a loose roller arrangement with one or more load rollers. If there is a pull on the free cable end with a particular force against a resistance force, the force to be applied is reduced in a way corresponding to the number of single cables between fixed and loose roller arrangement against the resistance force acting on the loose roller arrangement.

In one embodiment, the fixed roller arrangement of the cable-pull arrangement has two deflection rollers, which preferably have different diameters, and the loose roller arrangement has one deflection roller. Starting with the end of the cable detachably disposed on the loose roller arrangement, this cable is first led via a small deflection roller on the fixed roller arrangement, then via the deflection roller on the loose roller arrangement and then via a larger deflection roller of the fixed roller arrangement, so that the free of the cable can now be caught by an exercising person.

In an embodiment, the apparatus for exercising the muscles can comprise a support, on which are disposed the included exercising device and the cable-pull arrangement. The support can be fixed on a wall. The cable-pull arrangement can be fixed on the support or on the wall or attached to a fixing means. Moreover the exercising device can also be designed in such a way that it is able to be detachably disposed on a suitable structure independently of a support. For example, the exercising device can be disposed on gymnastic wall bars or a comparable support structure, and can be fixed, and, for expansion of the provided exercise spectrum, the cable-pull arrangement can be disposed at a related point of the wall bars by means of the first fixing device. By means of the second fixing device the cable-pull arrangement can be connected to the power arm in such a way that in any spatial direction, especially long-stroke movements can be practiced against the resistance of the spring element.

In an embodiment, a support is provided which is fixed to a wall or can be installed in a room, for example stretched in a tensioned way between ceiling and floor. The exercising device is able to be installed on the support in a height-adjustable way and can be locked in a set height position, whereby the cable-pull arrangement can be fixed on the support by means of the first fixing device. If the support is fixed standing free in the room, e.g. tensioned, exercises can be carried out in standing, sitting, lying or in other positions in the room.

Preferably provided on the support is a fixing possibility, for example in an upper region and/or a lower region, on which the cable-pull arrangement is detachably disposed. Preferably accommodations are provided on the support at a multiplicity of height positions, in order to receive the cable-pull arrangement with the first fixing element.

In a preferred embodiment, the apparatus for exercising the muscles is designed in such a way that the retaining element of the exercising device is connected to the support via a swivel joint, whereby it is rotatable in a plane of the support by 360° about a rotational axis of the swivel joint and is lockable in a set rotational position. Thereby achieved is that the power arm can be brought into any angular position, whereby a pressing, pushing and pulling in vertical, horizontal or any desired inclined position is possible. Hence, already by means of these adjustment possibilities, an apparatus for exercising the muscles is provided for different exercises and motion sequences.

Furthermore, the included spring element, also designated as compression-spring element, can be designed as pneumatic cylinder. The pneumatic cylinder can thereby be connected to a compressed air reservoir via a compressed air line in order to adjust the force acting upon the power arm virtually as desired.

The spring element can be connectible to the power arm at the first point of articulation, whereby the point of articulation is designed to be adjustable, so that by way of the adjustable distance of the point of articulation to the first articulated joint, the force effect and the characteristic of the force are changed on the path of movement of the power arm. A wide variety of force profiles can therefore be achieved.

According to the invention, in addition to the combination of the exercising device with a cable-pull arrangement designed as pulley, the apparatus for exercising the muscles can be supplemented in such a way that the apparatus can be used in the form of a rowing machine with a corresponding sequence of movements.

Rowing machines generally use a cable-pull arrangement, which is connected to a resistance element. The training person thereby sits on a seat able to slide parallel to the floor, for example a rolling seat movable along a track, and supports himself with his feet against a footrest or against the wall. His hands grasp a pull element, which is designed in such a way that, by pulling on the pull element and stretching or respectively bending his supported legs, the training person moves back and forth with the slidable seat along a travel path parallel to the floor. Furthermore, a rowing machine comprises a resistance element and a cable-pull arrangement connectible thereto.

Foreseen according to the invention is that the apparatus for training the muscles comprises the exercising device and a cable-pull arrangement and beyond that is combinable in a simple way with a track and a seat received thereon in a slidable way such that it can be used as a rowing machine.

Furthermore, the apparatus for exercising can be designed to be mobile; for example, in an advantageous way; the power arm and the resistance element of the exercising device are separable from one another at the first point of articulation, so that the power arm is pivotable against the retaining element. Beyond that, an actuation element received on the power arm can be separated, so that when the apparatus is not in use, it can be stowed away in a space-saving way. This also applies for the cable-pull arrangement and the retrofit element, i.e. the track and the seat received slidably thereon, of the rowing machine or respectively rowing device.

With a method according to the invention, the apparatus for exercising the muscles is able to be retrofitted in a simple way. Thus the cable-pull arrangement, which is fixable in a suitable position in a spatial relationship to the exercising device by means of the first fixing device, can be connected to this exercising device, whereby this cable-pull arrangement is connected to the power arm by means of the second fixing device. The free end of the cable provides end pieces for a training person, for example grips, which can be grasped for doing long-stroke exercises.

Furthermore, a method is encompassed, whereby the apparatus, in addition to the cable-pull arrangement, is able to be retrofitted with a track and/or a slidable seat, whereby a device of the rowing machine type is made available to a training person.

BRIEF DESCRIPTION OF THE DRAWINGS

An embodiment of the apparatus according to the invention for exercising the muscles will be explained more closely in the following with reference to the attached drawings.

DETAILED DESCRIPTION OF EMBODIMENTS OF THE INVENTION

Figure 1A:
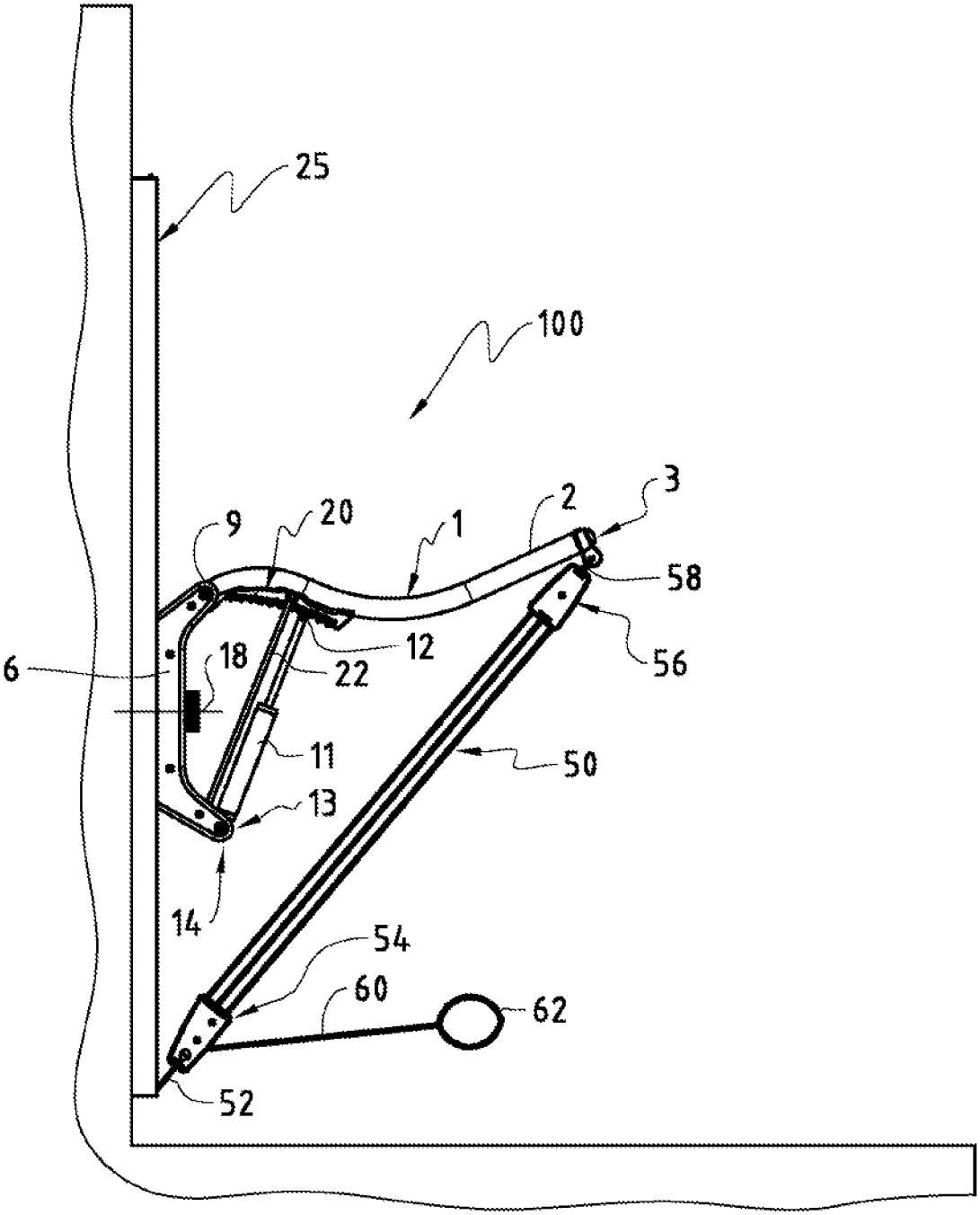
FIGS. 1A, 1B and 1C show in a side view the apparatus according to the invention for exercising the muscles with an embodiment of an exercising device with power arm and a cable-pull arrangement in different positions.
Figure 1B:
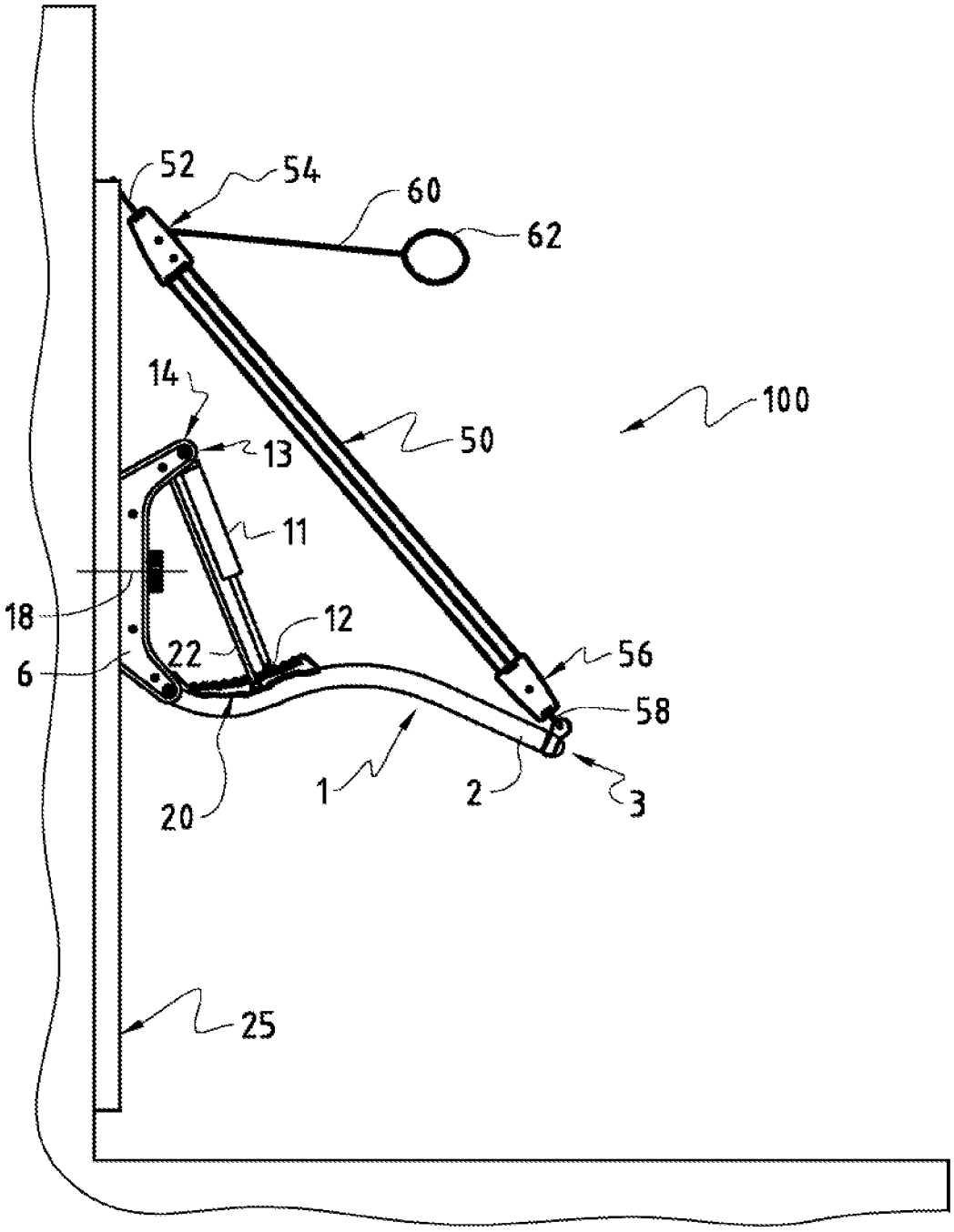
Figure 1C:
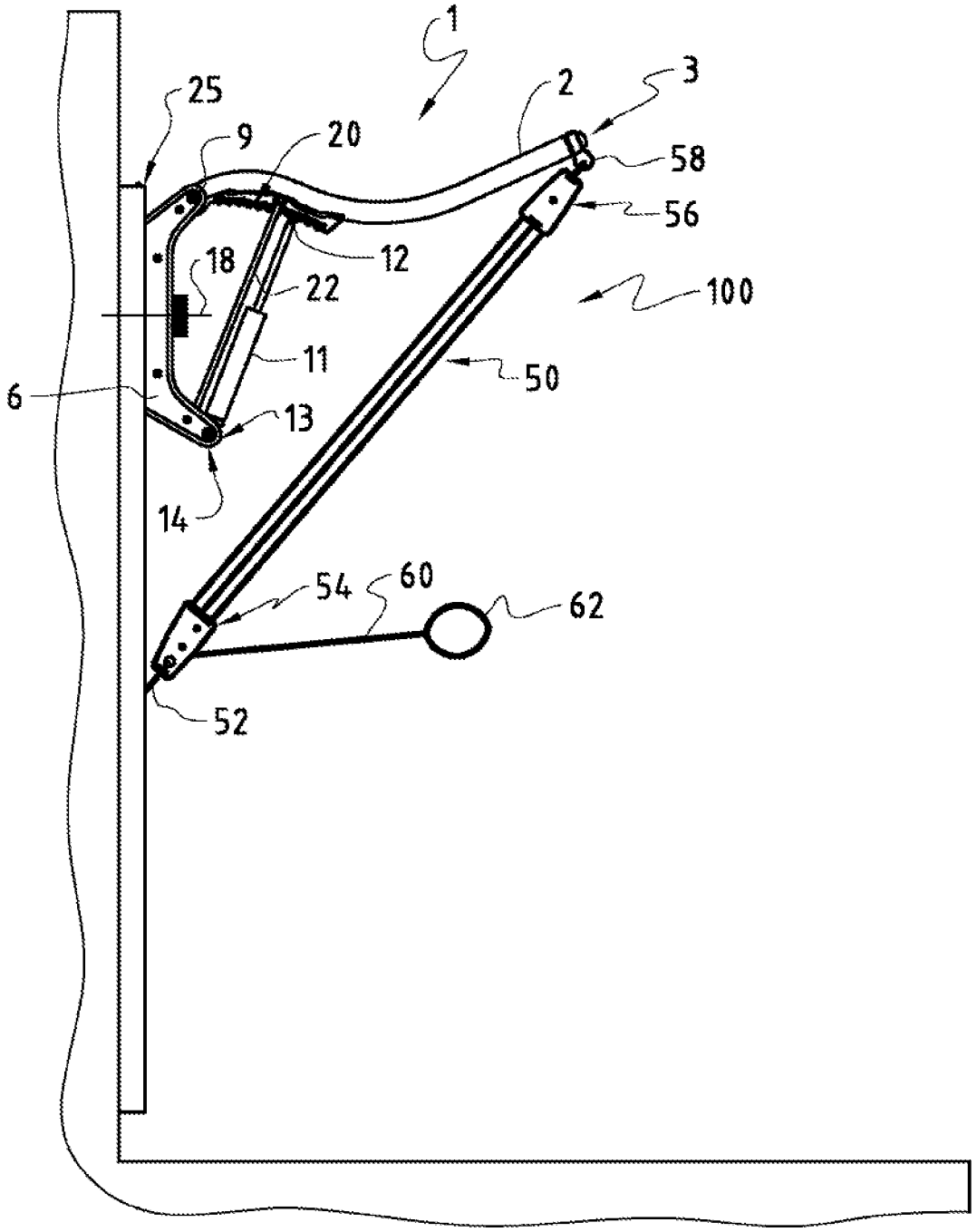

Presented in FIGS. 1A, 1B and 1C are side views of an apparatus 100 for exercising the muscles, whereby an exercising device 1 with a power arm 2 and a cable-pull arrangement 50 are included. The exercising device 1 comprises the power arm 2, connected to a retaining element 6 at a first articulated joint 9, in a way pivotable about a pivot axis, whereby the retaining element 6 is received in a height-adjustable way on a support 25. Furthermore, the retaining element 6 is rotatable about a rotational axis 18 in a plane of the support 25.

Furthermore, received in a pivotable way on the retaining element 6 at a point of articulation 14 is a second end 13 of a resistance device designed as compression-spring element 11, which resistance element is coupled in an articulated way to the power arm 2 via a point of articulation 12. The point of articulation 12 is adjustable along an adjustment area 20 designed on the power arm 2. Through the adjustment, the spacing of the point of articulation 12 with respect to the first articulated joint 9 or respectively the pivot axis changes in such a way that the force to be applied on the power arm 2 allows itself to be easily adjusted in a corresponding way.

In the embodiment shown, one end region of the compression-spring element 11 is provided with a first articular surface with a first curvature, which is designed to be complementary to a second curvature, designed as second articular surfaces on the power arm 2 by way of the adjustment area 20. Accordingly the compression-spring element 11 with the first articular surface is able to be brought into engagement with the second articular surface on the power arm 2. Furthermore, an element 22 is provided which is designed to keep in contact the two engaging first and second articular surfaces. The element 22 can be designed as elastic band, which can be fixed by its one end to the power arm 2 in a detachable or fixed way, and which is fixable by its other end on the retaining element 6, preferably in the region of the point of articulation 14.

In the representation of FIGS. 1A, 1B and 1C, the cable-pull arrangement 50 is designed as pulley, comprising a fixed roller arrangement 54 and a loose roller arrangement 56. Designed on the fixed roller arrangement 54 is a first fixing device 52, by means of which the cable-pull arrangement 50 can be detachably fixed on the support 25. Provided on the loose roller arrangement 56 is a second fixing device 58 designed as hook, which second fixing device can be received in a detachable way in an accommodation on an end region on the power arm 2, for example can be hooked into the accommodation formed there. The cable-pull arrangement 50 comprises a cable 60, on whose free end gripping means 62 are disposed, for example grips or handles.

In the representation of FIG. 1A, the fixed roller arrangement 54 is attached by means of the first fixing device 52 to a lower position on the support 25 designed e.g. as stand or pillar. Among other things, long-stroke movement sequences can be practiced with this configuration, for example in standing, sitting, or lying position and both with the arms as well as with the legs. The gripping means 62 can thereby be designed as a cuff, which can be attached in a foot area of an exercising person, whereby three-dimensional, long-stroke exercises with the leg in all spatial directions can be performed.

Shown in FIG. 1B is an apparatus 100 for exercising the muscles which is comparable to that of FIG. 1A. Here the exercising device 1 is disposed on the support 25 in an orientation rotated by 180° with respect to FIG. 1A, and the cable-pull arrangement 50 with the first fixing device 52 is fixed on the support 25 in an upper region. A pull on the gripping means 62 of the cable-pull arrangement 50 thereby causes a pivot motion of the power arm 2 upwards against the force applied by the compression-spring element 11.

Shown in FIG. 1C is likewise a comparable apparatus 100 for exercising the muscles. The exercising device 1 is in an orientation as represented in FIG. 1A but is located however in an upper position on the support 25. The cable-pull arrangement 50 is fixed on the support 25 by means of the first fixing device 52 below the exercising device 1. With actuation of the cable-pull arrangement 50 a pulling movement is transmitted via the cable 60 of the cable-pull arrangement 50 to the power arm 2, which is moved downward against the compression-spring element force.

Figure 2A:
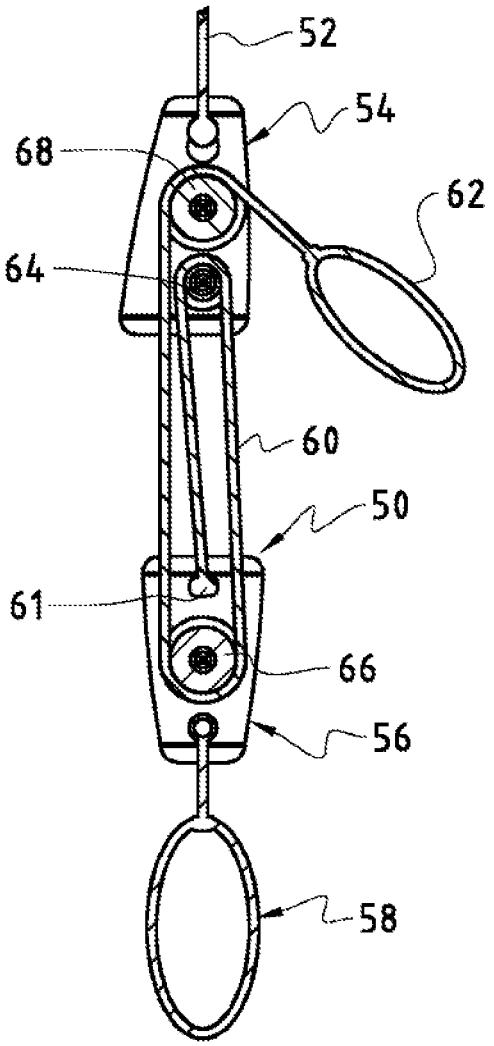
FIGS. 2A and 2B show in a sectional representation a first and a second embodiment of the cable-pull arrangement according to the invention, designed as pulley.
Figure 2B:
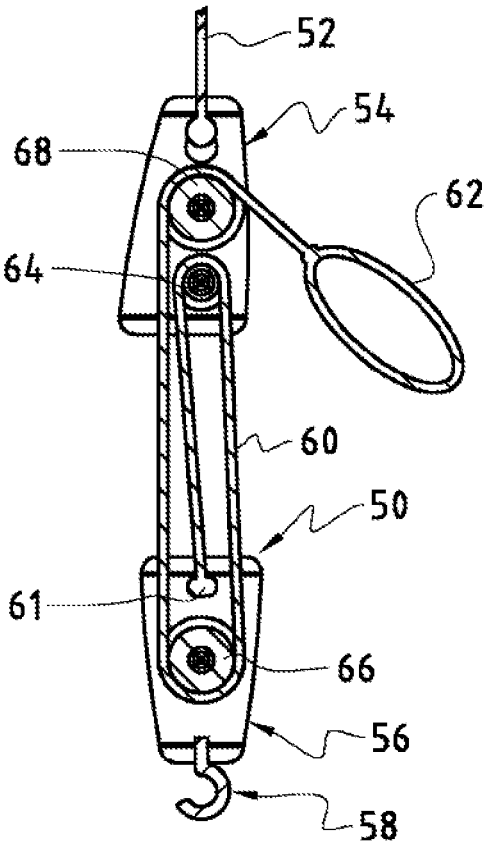

Shown in FIGS. 2A and 2B is in each case the cable-pull arrangement 50 in a sectional representation. Discernible is the fixed roller arrangement 54, on which the first fixing device 52 is disposed. The first fixing device 52 can be designed, for example, as flexible element with end pieces which are detachably fixed, each in corresponding accommodations on the cable-pull arrangement 50 and on a permanently installed fastening means, e.g. disposed on the support 25. Of course it is however conceivable to design these first fixing devices differently, for example in the form of loops, hooks or other suitable devices. Shown furthermore is the loose roller arrangement 56, on which the second fixing means 58 is disposed likewise in a detachable way. In FIG. 2A the second fixing device 58 is designed as loop, which can be wrapped around the power arm 2, or respectively an actuation element 4 (not shown). In FIG. 2B the second fixing device 58 is designed as hook, which can simply be hooked into an accommodation on the power arm 2. Here too other embodiments are absolutely conceivable.

The cable-pull arrangement 50 comprises the cable 60, whose free end has gripping means 62. Another end 61 of the cable 60 is received in a detachable way on the loose roller arrangement 56. Starting from this end 61, the cable 60 runs via a first roller 64, disposed on the fixed roller arrangement 54, preferably with a small diameter, then via a second roller 66, provided on the loose roller arrangement 56, and from there the cable 60 is led via a third roller 68, which is disposed on the fixed roller arrangement 54 and has preferably a larger diameter than the first roller 64. The cable 60 can be implement with any desired length. Above and beyond that, further rollers or respectively other arrangements of the rollers in the fixed or respectively loose roller arrangements 54, 56 are conceivable. With the cable-pull arrangement 50 in the example shown, the force provided by the compression-spring element 11, with which the power arm 2 in the exercising device 1 is acted upon, is divided by three, in a way corresponding to the number of cables.

Figure 3:
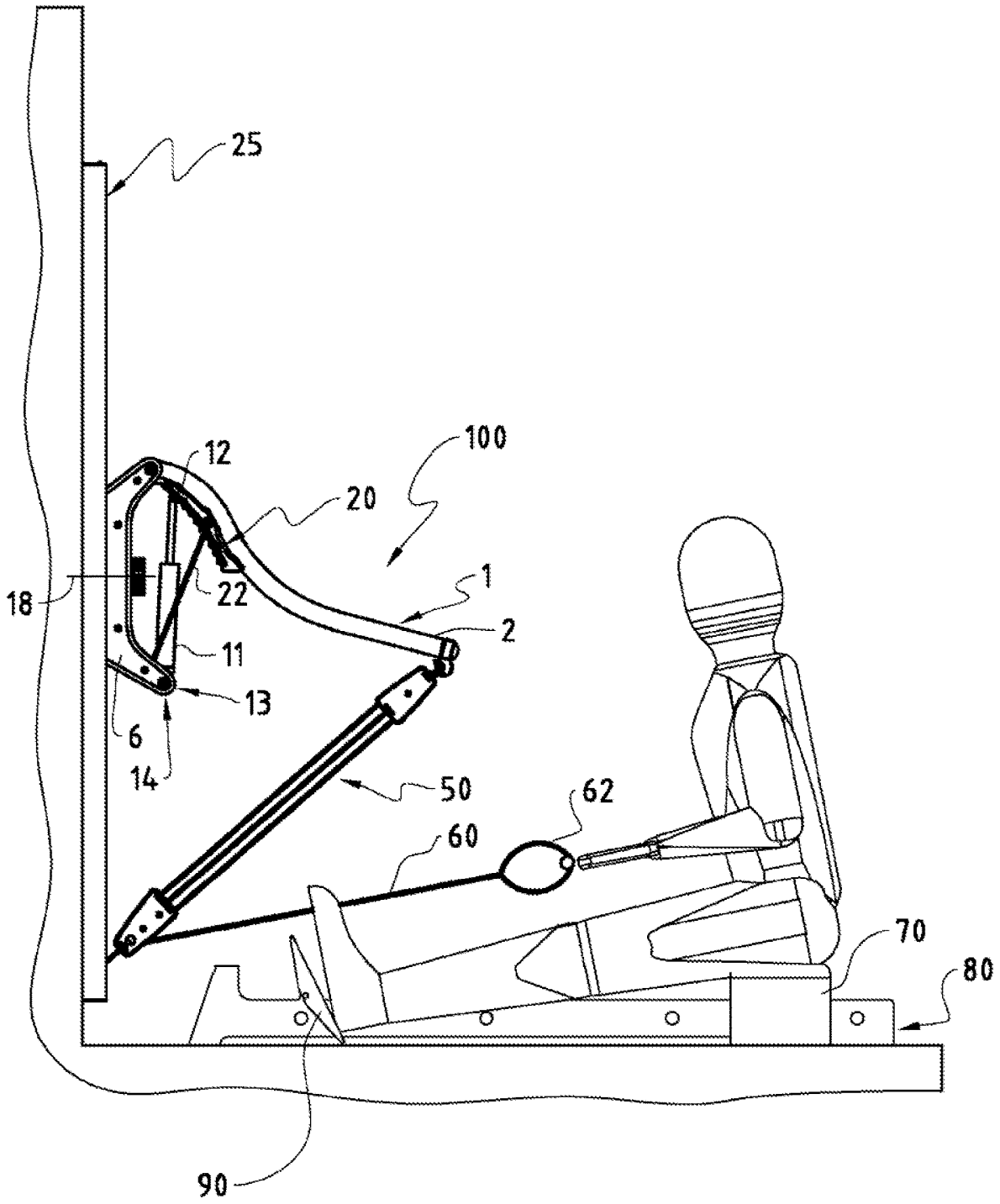
FIG. 3 shows in a side view the apparatus for training muscles according to the invention designed as rowing machine.

FIG. 3 shows the apparatus 100 for exercising the muscles acting as a rowing machine. The retaining element 6 is set and locked at a middle height on the support 25. The cable-pull arrangement 50 designed as pulley is connected to the exercising device 1 or respectively to the power arm 2 and the support 25 in such a way that gripping means 62 are graspable for a sitting exercising person. The exercising person sits on a movable seat or respectively carriage 70, which is displaceable in horizontal direction along a track 80 parallel to the floor. The exercising person thereby braces himself with his feet against a footrest 90 or against a wall. By pulling on gripping means 62 of the cable 60 of the cable-pull arrangement 50, which results in a vertical movement of the power arm 2, and by bending and stretching his legs while moving the slidable seat 70 along the track 80, a rowing movement of the entire body of the exercising person is made possible.

The invention claimed is:

1. Apparatus for exercising the muscles, comprising an exercising device having a power arm configured to be equipped with actuating elements at a first end of the power arm, and a second end of the power arm is arranged on a retaining element in a way pivotable about a pivot axis at a first articulated joint, a compression-spring element coupled in an articulated way at a first end of the compression-spring element at a first point of articulation on the power arm, the compression-spring element being coupled in an articulated way at a second end of the compression-spring element at a second point of articulation on the retaining element, and a cable-pull arrangement having a cable, with the cable-pull arrangement being fixed in a spatial relationship to the exercising device in a releasable manner, independently of the exercising device, by means of a first fixing device, said cable-pull arrangement being configured to be combined with the power arm of the exercising device by means of a second fixing device so that the cable-pull arrangement is connectible to the exercising device for training to take place.

2. The apparatus according to claim 1, wherein the cable-pull arrangement comprises a pulley system with a fixed roller arrangement and a loose roller arrangement, wherein both the fixed roller arrangement and the loose roller arrangement comprise one or more rollers via which a cable is led.

3. The apparatus according to claim 1, wherein the cable of the cable-pull arrangement has an end detachably connectible to one of the roller arrangements and a free end with a gripping means.

4. The apparatus according to claim 1, wherein the first and second fixing devices are detachably mounted on the cable-pull arrangement.

5. The apparatus according to claim 1, further comprising a support fixable to a wall or in a room and which the retaining element is connectible to.

6. The apparatus according to claim 5, wherein the retaining element is installable in a height-adjustable way on the support and is lockable at a set height position, the cable-pull arrangement being detachably connected on the support via the first fixing device.

7. The apparatus according to claim 5, wherein the retaining element is connected to the support via a swivel joint and is pivotable about the support in a plane of the support and orthogonal to the pivot axis of the power arm, and is lockable in a set rotational position.

8. The apparatus according to claim 1, wherein the power arm and the compression-spring element at the first point of articulation are separable from one another and the power arm is pivotable toward the retaining element.

9. The apparatus according to claim 1, further comprising a track extending horizontally with respect to a floor and a seat movable thereon.

10. The apparatus according to claim 9, wherein the cable-pull arrangement and the track provided with the movable seat are combinable with the exercising device so that together they define a rowing machine.

11. The apparatus according to claim 1, further comprising an actuation element affixed or affixable to the cable of the cable-pull arrangement, said actuation element including at least one of gripping means, straps, loops and/or wristbands or cuffs.

12. Method for retrofitting an apparatus according to claim 1, wherein the cable-pull arrangement is fixed by means of the first fixing device at one point in spatial relationship to the exercising device and the second fixing device is connected to the power arm, so that a free end of the cable is accessible to be gripped and moved against a resistance force of the compression-spring element.

13. The method for retrofitting an apparatus according to claim 12, further comprising positioning a track extending horizontally with respect to a floor and a having seat movable thereon adjacent to the exercising device so that together they define a rowing machine.

* * * * *